US010694829B1

(12) United States Patent
Diamonds

(10) Patent No.: US 10,694,829 B1
(45) Date of Patent: Jun. 30, 2020

(54) SMART CONTAINER WITH ILLUMINATION SOURCE

(71) Applicant: Mike Diamonds, Napa, CA (US)

(72) Inventor: Mike Diamonds, Napa, CA (US)

( * ) Notice: Subject to any disclaimer, the term of this patent is extended or adjusted under 35 U.S.C. 154(b) by 0 days.

(21) Appl. No.: 16/350,584

(22) Filed: Dec. 1, 2018

Related U.S. Application Data

(63) Continuation-in-part of application No. 15/011,528, filed on Jan. 30, 2016.

(51) Int. Cl.

| | |
|---|---|
| ***B67D 1/07*** | (2006.01) |
| ***A45D 33/32*** | (2006.01) |
| ***F21V 33/00*** | (2006.01) |
| ***B65D 23/04*** | (2006.01) |
| *A45D 34/00* | (2006.01) |
| *F21Y 115/10* | (2016.01) |

(52) U.S. Cl.
CPC ..... *A45D 33/32* (2013.01); *B65D 23/04* (2013.01); *F21V 33/0004* (2013.01); *A45D 2034/002* (2013.01); *A45D 2034/007* (2013.01); *B65D 2203/12* (2013.01); *F21Y 2115/10* (2016.08)

(58) Field of Classification Search
CPC ..... A45D 33/32; A45D 2034/007; A45D 2034/002; F21V 33/0004; B65D 23/04; B65D 2203/12; F21Y 2115/10
See application file for complete search history.

(56) References Cited

U.S. PATENT DOCUMENTS

| | | | |
|---|---|---|---|
| 2,745,947 | A | 5/1956 | Sansous |
| 2,765,481 | A | 10/1956 | Manhart et al. |
| 4,209,259 | A | 6/1980 | Rains et al. |
| 4,344,113 | A | 8/1982 | Ditto et al. |
| 4,490,931 | A | 1/1985 | Fleemin |
| 4,700,871 | A | 10/1987 | Matsuo et al. |
| 4,827,642 | A | 5/1989 | Chatten |
| 4,913,555 | A | 4/1990 | Maeda et al. |
| 4,922,355 | A | 5/1990 | Dietz et al. |
| 5,141,327 | A | 8/1992 | Shiobara |
| 5,586,823 | A | 12/1996 | Carr |
| 5,743,620 | A | 4/1998 | Rojas et al. |
| 5,785,407 | A | 7/1998 | Ratcliffe et al. |
| 6,065,848 | A | 5/2000 | Tucker et al. |
| 6,163,248 | A | 12/2000 | Paek et al. |
| 6,241,359 | B1 | 6/2001 | Lin |

(Continued)

FOREIGN PATENT DOCUMENTS

WO 2009007238 A1 1/2009

*Primary Examiner* — David P Angwin
*Assistant Examiner* — Bob Zadeh
(74) *Attorney, Agent, or Firm* — Banner & Witcoff, Ltd.

(57) ABSTRACT

A smart container capable of illuminating, mixing, blending, warming and dispensing media comprising glow-in-the-dark substances, cosmetics, masks, scrubs, lotions and oils to be applied to the body, the control of which is accomplished either by the container, or a smart device such as a phone, tablet, computer or smart watch. Either of the smart device or container being capable of independently recording video, audio, still photos and full capability live streaming of the use of said media or controlling the other to perform the same functions, either or both in any combination allowing the sharing of said recordings, audio or video or said live streaming content on social media platforms as directed by the user.

7 Claims, 12 Drawing Sheets

(56) References Cited

U.S. PATENT DOCUMENTS 6,254,247 B1 7/2001 Carson
6,305,817 B1 10/2001 Johnston et al.
6,352,352 B1 3/2002 Schletterer et al.
6,371,624 B1 4/2002 Dorney
6,443,589 B1 9/2002 Lee
6,508,022 B2 1/2003 Huang
6,592,007 B2 7/2003 Ho et al.
6,793,362 B2 9/2004 Tai
6,793,363 B2 9/2004 Jensen
7,018,062 B2 3/2006 Taylor
7,258,458 B2 8/2007 Mochiachvili et al.
7,401,935 B2 7/2008 VanderSchuit
7,419,072 B1 9/2008 Vanella
7,434,983 B2 10/2008 Terentiev
7,690,533 B2 4/2010 Stilley
7,695,186 B2 4/2010 Terentiev
7,762,716 B2 7/2010 Terentiev et al.
7,765,716 B2 8/2010 Kim
7,832,922 B2 11/2010 Schoeb
8,344,290 B1 * 1/2013 Hinton ..... F27D 11/00 219/429
8,690,418 B2 4/2014 Ludwig et al.
9,565,970 B2 2/2017 Alet Vidal et al.
9,873,097 B1 1/2018 Dushine et al.
2002/0047024 A1 4/2002 Ho et al.
2003/0067764 A1 4/2003 Lau Ting Yup et al.
2004/0047232 A1 * 3/2004 Terentiev ..... B01F 7/00908 366/273
2005/0073833 A1 * 4/2005 VanderSchuit .... A47G 19/2222 362/101
2005/0180146 A1 8/2005 VanderSchuit
2006/0139928 A1 6/2006 Griffiths et al.
2007/0007304 A1 1/2007 Bitton
2008/0057089 A1 3/2008 Molina
2009/0166378 A1 * 7/2009 Stilley ..... B05B 11/0037 222/39
2010/0085737 A1 * 4/2010 Yang ..... F21S 6/001 362/101
2013/0001220 A1 * 1/2013 Alet Vidal ..... A47J 43/0465 219/622
2016/0073820 A1 * 3/2016 Alet Vidal ..... A47J 36/165 99/337

* cited by examiner

FIG. 2A
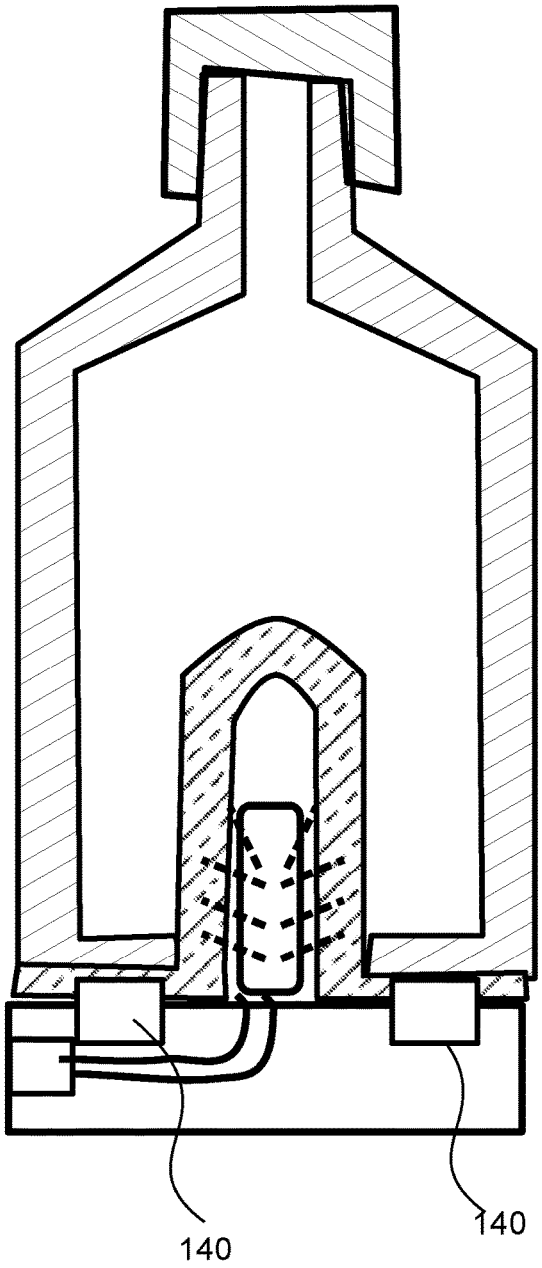
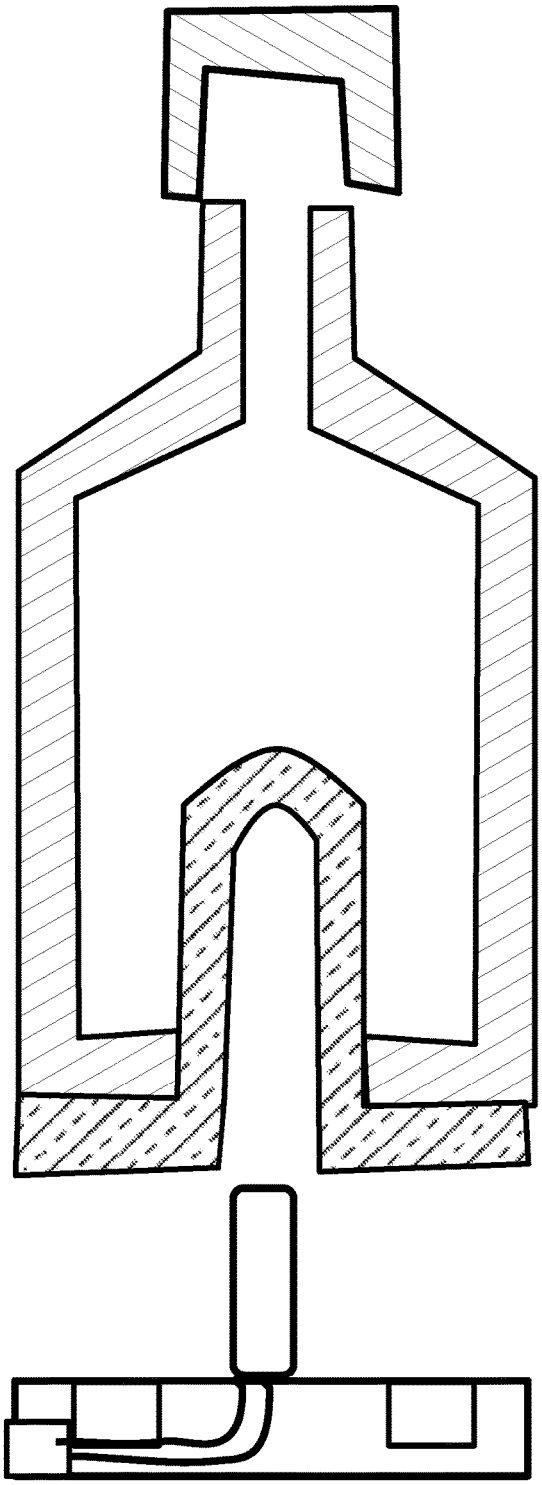
FIG. 2B

FIG. 3A
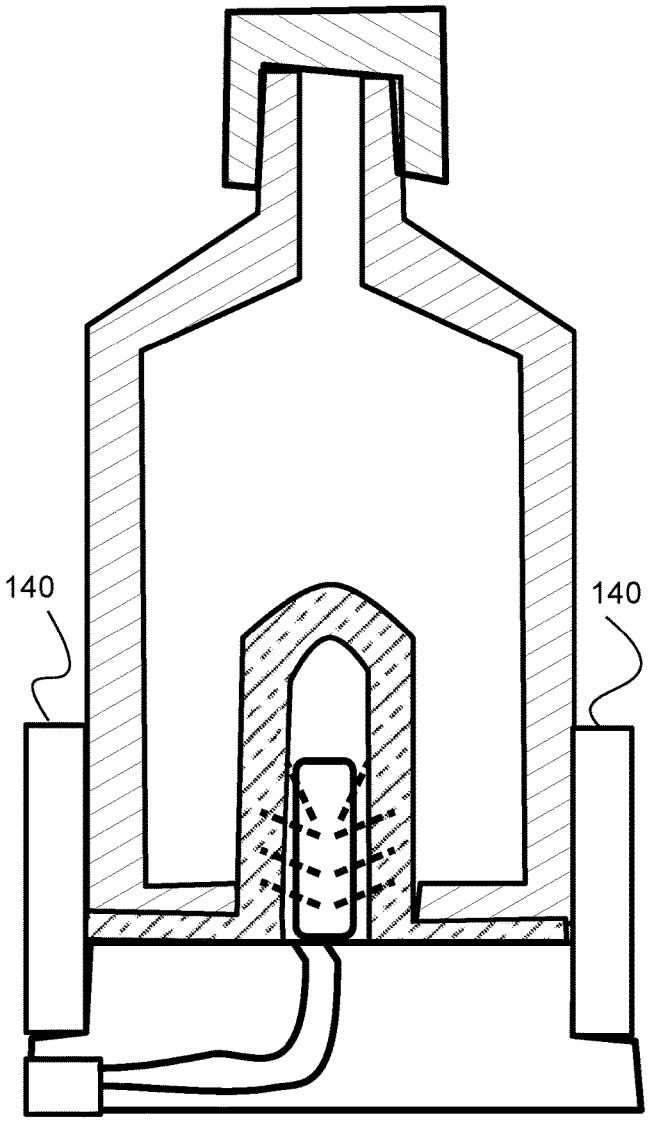
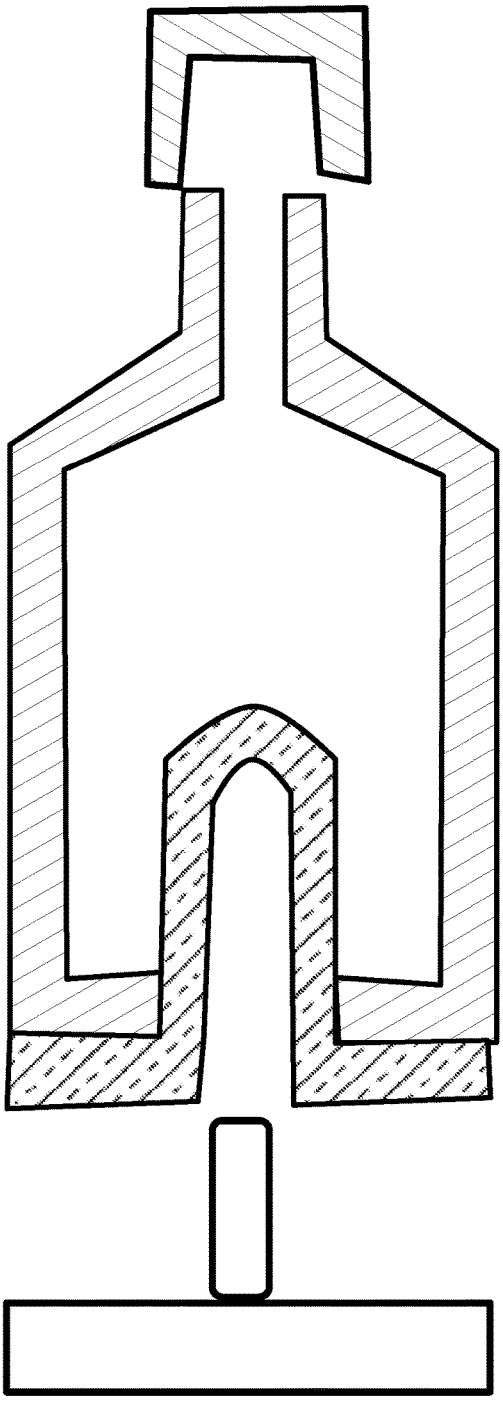
FIG. 3B

FIG. 4A
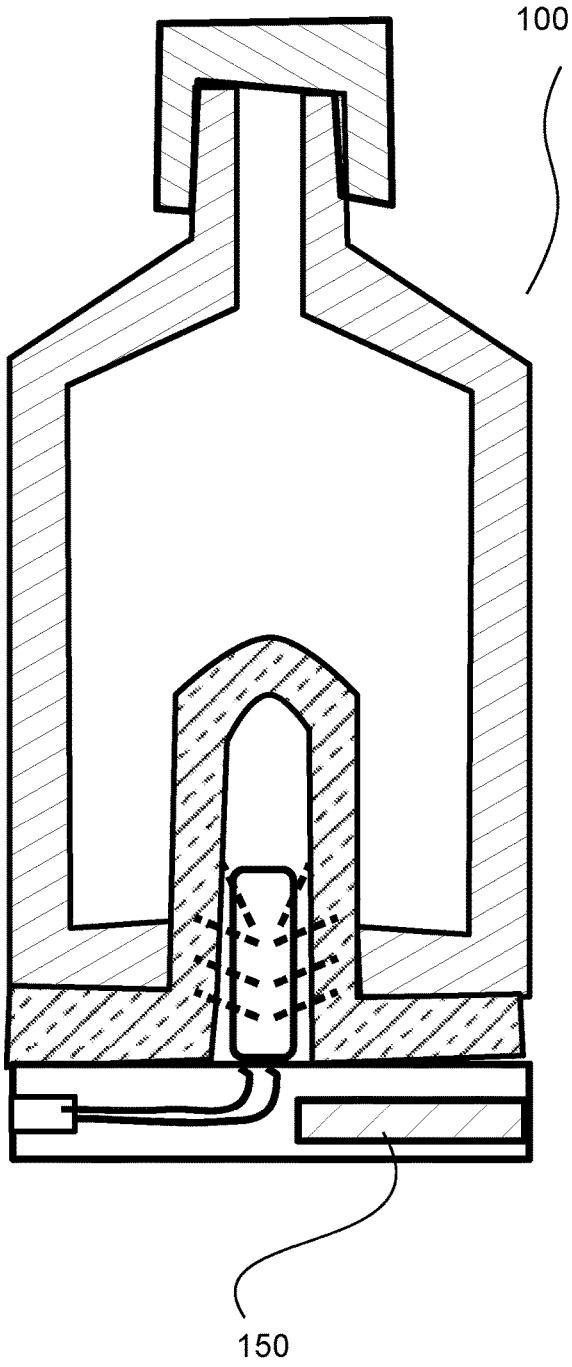
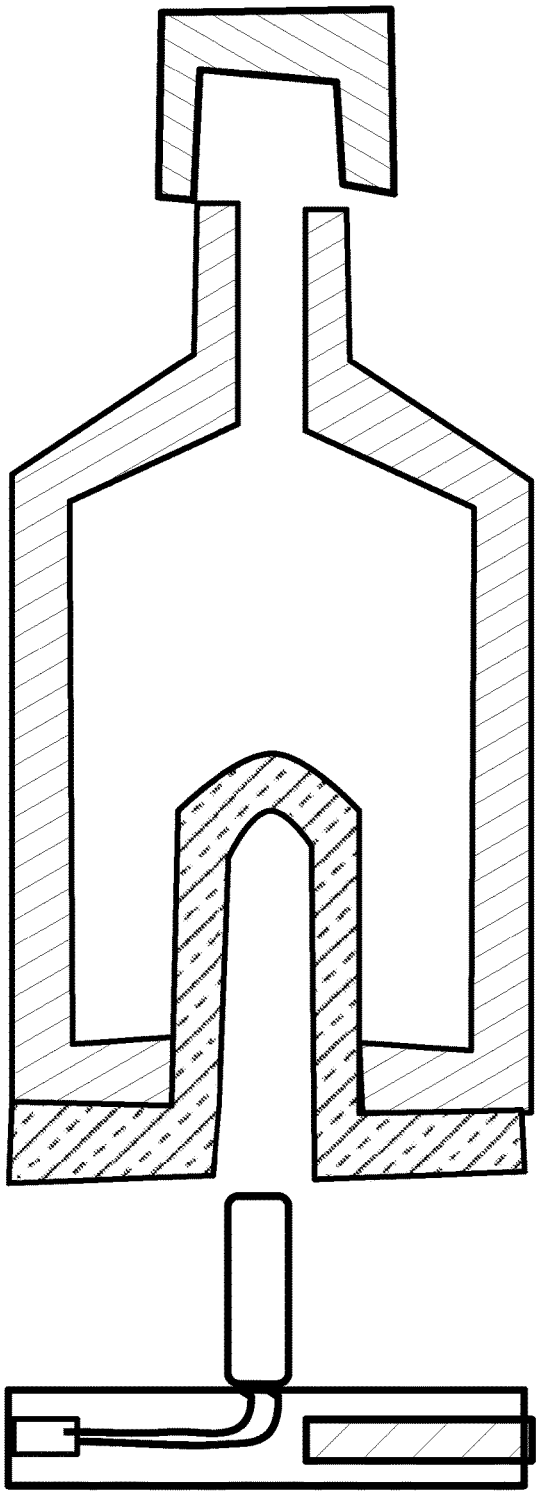
FIG. 4B

FIG. 5A
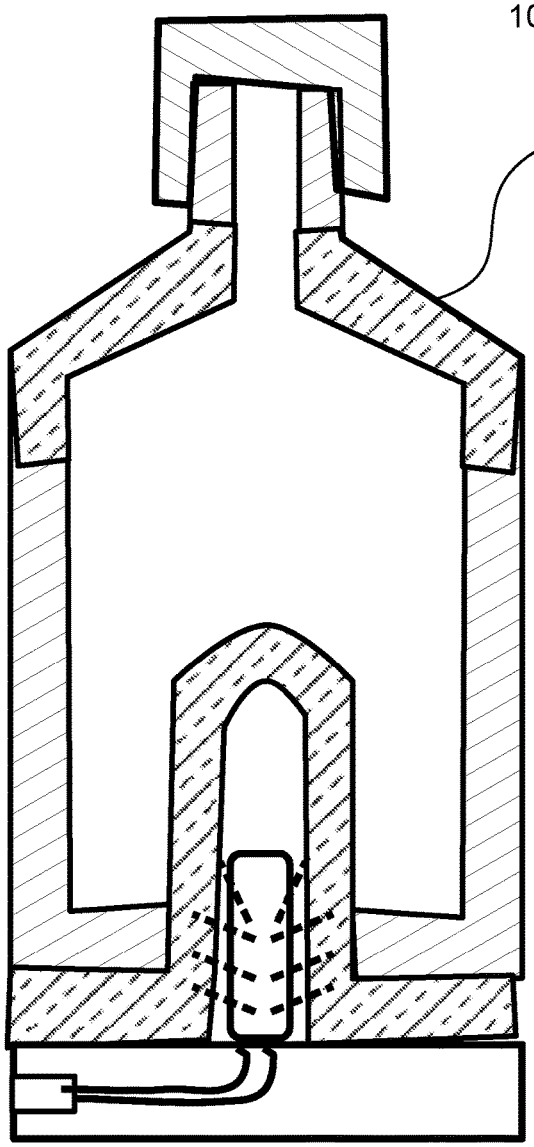
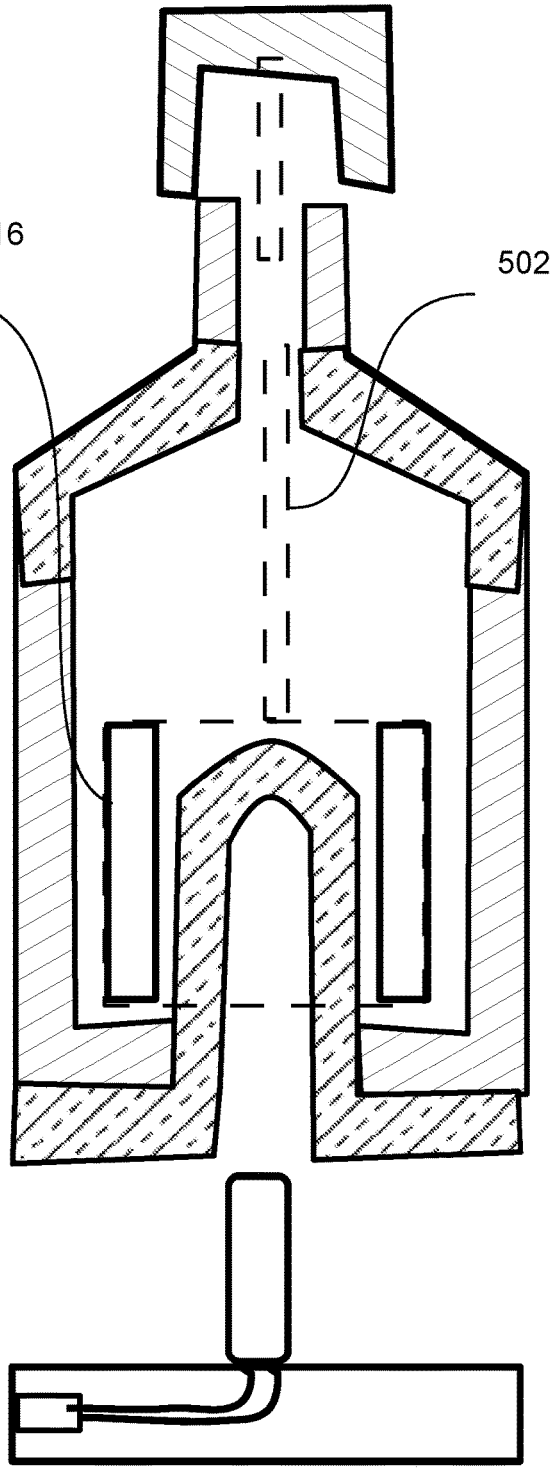
FIG. 5B

SMART CONTAINER WITH ILLUMINATION SOURCE

REFERENCE TO RELATED APPLICATIONS

The present application is a continuation-in-part application of United States nonprovisional patent application that was filed Jan. 30, 2016, having Ser. No. 15/011,528, which claims the benefit of priority to the United States provisional patent application that was filed on Dec. 1, 2015, having Ser. No. 62/085,975, which are incorporated herein by reference.

FIELD OF THE INVENTION

Applicant's invention is in the field of storage and dispensing of fluid, which may be personal care products such as creams, lotions or gels and related fluids for topical application as well as body paints for fashion and entertainment.

BACKGROUND OF THE INVENTION

The field of the invention is the storage and dispensing of fluid, which may be personal care products, such as creams, lotions or gels and related fluids for topical application, as well as body paints for fashion and entertainment, and in particular containers for the same.

Light emitting personal lubricants are disclosed in the US patent application having application serial number US2008/0057089 A1, which published on Mar. 6, 2008, which is incorporated herein by reference.

However, the luminescent properties of such products depend on exposure to a light source after they are applied to a person. Thus, the area of application may not be visible until the light source is applied, and then lighting is extinguished to see where the material has been applied.

Alternatively, the area of application may be visible in the substantial absence of visible light, provided UV or near UV light, such as "black light" are deployed. However, depending on the luminescent properties of the fluid, the light emission might not occur immediately as the fluid is applied.

It would be advantageous to overcome the above limitations.

The above and other objects, effects, features, and advantages of the present invention will become more apparent from the following description of the embodiments thereof taken in conjunction with the accompanying drawings.

In the one aspect of the present invention, a first object is achieved by providing a fluid dispenser comprising a container having a bottom portion, substantially upright side wall surrounding the bottom portion which terminate at an upper rim, and a cap removably connected to an upper portion of the container, wherein the portions of the container between the bottom portion and sidewalls defines a cavity for confining a fluid, a transparent inner annulus that extends upward from the bottom portion of the container at least partly upward into said cavity, a means to connect an illuminating base to the bottom of the container so as to dispose a light source in optical communication within the inner annulus to irradiate fluid contents within the cavity.

A second aspect of the invention is characterized by such a fluid dispenser wherein the illuminating base further comprises a heating element that is disposed in thermal communication with one of the bottom and a lower portion of the sidewalls of the container when the light sources disposed within the inner annulus.

Another aspect of the invention is characterized by any such fluid dispenser wherein the illuminating base further comprises an external socket for receiving a power connection, were in the external socket is wired to one or more of the light source and the heating element.

Another aspect of the invention is characterized by any such fluid dispenser wherein the lighting element is a light emitting diode (LED).

Another aspect of the invention is characterized by any such fluid dispenser wherein the light emitting diode emits blue light.

Another aspect of the invention is characterized by any such fluid dispenser wherein the illuminating base is removably attachable to the bottom of the container with a least one of a snap, bayonet or screwed fitting.

Another aspect of the invention is characterized by any such fluid dispenser wherein the sidewalls of the container our deformable to squeeze fluid from the container.

Another aspect of the invention is characterized by any such fluid dispenser wherein the fluid dispenser further comprises a fluid having dispersed or dissolved luminescent material therein at least partially filling the container.

Another aspect of the invention is characterized a fluid dispenser comprising a container having a bottom portion, substantially upright side walls surrounding the bottom portion which terminate at an upper rim, and a cap removably connected to an upper portion of the container, wherein the portions of the container between the bottom portion and sidewalls defines a cavity for confining a fluid, wherein at least one of the bottom and a portion of the substantially upright walls are transparent, a means to connect an illuminating base to the bottom of the container so as to dispose a light source in optical communication to irradiate contents within the cavity.

Another aspect of the invention is characterized by any such a fluid dispenser wherein the illuminating base is removably connected to the bottom of the container so as to dispose a light source in optical communication with at least one of the bottoms and a portion of the substantially upright walls.

Another aspect of the invention is characterized by any such a fluid dispenser wherein the illuminating bases comprises a plurality of light sources for illuminating the substantially upright walls of the contains and at least a part of the illuminated portions of the upright walls are covered by an external reflector to re-direct light toward the cavity.

Another aspect of the invention is characterized by any such a fluid dispenser wherein the cavity contains a luminescent fluid.

Another aspect of the invention is characterized by any such a fluid dispenser wherein the container further comprises an at least partially transparent inner annulus that is in optical communication with one or more light sources of the illuminating base to irradiate fluid contents within the cavity that surround the inner annulus.

Another aspect of the invention is characterized by any such a fluid dispenser wherein a light source extends upward into the inner annulus.

Another aspect of the invention is characterized by any such a fluid dispenser wherein the at least partially transparent inner annulus has a central metallic reflector and is illuminated from below by an attached light source or a light source disposed in the base.

Another aspect of the invention is characterized by any such a fluid dispenser wherein the base further comprises at least one of a battery, transceiver, transmitter, controller, heater, thermal sensor and display.

Another aspect of the invention is characterized by any such a fluid dispenser wherein the base further comprises at least one of a controller and display in which the controller is operative to activate the display to indicate when the contents are at least one of ready for use, should be stirred or mixed, should be allowed to heat or be illuminated further.

At present, many smart devices are available for users to access information such as music or audio books, communications with friends and loved ones, shopping, calendaring events, creating to do lists, operating devices such as appliances, operating a television, stereo or simply communications enabled wireless speakers and more.

With the advent of wireless technology, social media and consumer interest in various games, messaging and sharing of real-time experiences such as "selfies", technology driven group activities and common interests, the enabling of various objects and products to drive such consumer interests is continuing to become more popular. Examples include such things as "Go Pro®" cameras, selfie sticks, interactive photo displays, and other facilitation means which drive social media. It is an object of the present invention to provide a way to integrate: cosmetics of all kinds which can be mixed, heated and otherwise prepared for use; lotions, lubricants, massage oils, GITD liquids and lubricants into an experience which can provide a fun social media experience for the user.

Children and adults alike enjoy activities such as finger painting, applying cosmetics, using lotions for massage or health applications such as for sore muscles or simply moisturizing or treating the skin. In addition, children love to have their faces painted at fairs, events or other venues and celebratory times such as Christmas, Easter, Halloween and other holidays or special occasions such as a birthday parties, or the like. What is not readily available is a way to marry the face painting, cosmetic application, finger painting and other of the aforementioned activities in a way that can take advantage of smart devices to provide a fun and pleasurable experience melding these various activities. What is needed is a platform where children can create another dimension of the aforementioned activities in the sense of sharing these activities on social media through the use of smart devices.

Taking these activities a step further is the integration of glow in the dark ("GITD") media which can turn ordinary face painting or use of body or massage lotions into an even more fun and exciting experience. What is needed then is a way to apply GITD material into safe-to-use media comprising lotions, oils and cosmetics.

Taking the foregoing to the next step, by using smart technology to take advantage of GITD media in the social arena, a smart device must be adaptable to enabling users to share their activities over the internet or other communications media. Currently, smart phones provide one of the most mobile means of accessing social media for sharing images or other communications through traditional social platform applications.

To insert the GITD component or other preparation of these media, comprising among others: lotions, oils, cosmetics, etc. into condition for proper use, there must be a means to prepare such media providing as necessary illumination, mixing, blending, heating or other preparations dictated by that particular media; be it a GITD substance, a lotion, a cosmetic, an oil or a combination thereof. The typical smart phone is not capable of such functions but can be utilized through a specialized app to control a companion device capable of performing the necessary preparation steps.

What is needed then is a way to handle GITD media and other lotions and cosmetics in a way to interface with social media and which can provide a variety of functions for not only media preparation, but also an interface either directly to the internet for using social media platforms but also interfacing with a smart phone or other communications device capable of recording, video, audio, still photos as well as full capability live streaming of the aforementioned activities.

What is needed then is a "smart" GITD media preparation device capable of illuminating GITD media, mixing and blending a wide variety of cosmetics, lotions and oils with the additional capability of warming said media to a proper predetermined temperature.

Applicant's invention relates generally to controlling a container designed to bring various substances such as liquids, oils, cosmetics or glow-in-the-dark ("GITD") mixtures to proper temperature, viscosity and in some cases illumination in preparation for personal use. The addition of remote or wireless access to container status and operation through microprocessor control and additional provisions for broadcasting the use of said container and substances via social media elevate the container to status as a "smart" interactive container.

The overall remote processing utilizing wireless and other technologies for the control of substance preparation devices is known in other industries. For example, a culinary process described in U.S. Pat. No. 10,058,206 B2 granted Aug. 28, 2018 to Cote, et al. disclosing web based culinary device control using a client application demonstrates the kind of control Applicant foresees for his Smart Container. However, the application of this technology is quite different in the way Applicant employs processing in actually creating a device which can function independently from a device run client application as well as interface with same.

SUMMARY OF THE INVENTION

Applicant has built upon the technology disclosed in the specification of the above referenced parent application, its drawings and claims and particularly as depicted in FIGS. 7 and 9 of the parent application, creating a "smart" container with capability for remote, temperature-precise illumination activation, mixing and blending control for cosmetics, oils and lotions with a social media integration for user sharing and entertainment.

It is an objective of Applicant's invention that virtually any cosmetic, face cream, scrub, mask, or lotion which is of a liquid nature and may be best used at a predetermined temperature, viscosity or illumination may be a subject of social media interaction with Applicant's enhancement of his previous invention.

Control over these functions may be performed both in real-time or as scheduled for a predetermined time, appointment or event. The apparatus and method employs software process control for monitoring and recording a heating element for safe temperatures, a light source for illumination, a drive shaft or other means such as a magnetic coupling to control fan blades or paddles or other mechanisms to mix and blend the substances.

It is an object of the present invention to provide a container which can mix, blend, heat or illuminate the aforementioned media substances remotely by the user.

A client application provides the interface between the user and the smart container via several means of communication such as WiFi, Bluetooth, NFC, RFID, LTE, 5G and other IoT protocols.

This method includes an Automatic Process Interface or "API" which authenticates client applications using a combination of user and password, RSA public key and/or a token obtained in a previous authentication. Using the same means, various connector kits (local or in the cloud) are also authenticated using the same means.

The API allows a connector kit (local or in the cloud) to send data regarding: available sensors, available relays and controls; historical and real-time temperature data; and confirmation of proper mixture conditions. The API further allows the client applications to use this information to compare with information by substance regarding requirements for: mixing, heating, illumination all based on volume, for determining a batch sequence and time duration for use as soon as possible or to be performed for a scheduled date and time.

A "websocket" is used for real-time communication between connectors and client applications but also communicates with the API as well for various functions such as authentication of the connector or the client application, online notification and commands or verifications. The websocket mainly acts as a proxy between the connector and the client app but is not solely limited to that function.

Client Applications may provide input from a web-based platform or website, a mobile desktop application to which a user logs into an established account for communication with the API. A websocket server may also be employed to perform the aforementioned actions and in addition is capable of communicating directly with the connectors if the network is setup to allow tcp/ip connections in absence of an internet connection and may therefore perform actions like viewing available historical data, viewing available sensors and relays, permitting the verification or confirmation of specific batches of cosmetics, starting and/or stopping a batch in accordance with a specific set of instructions.

"Connector kits" (local or in the cloud) authenticate against the cloud API and connect to the websocket in order to advertise its presence online and send live information if requested. They further send information to the cloud API in order to save and store said information in a database. The information includes but is not limited to historical data, signatures, but may include verification/sign-off data performed on the client application while in communication with the connector kit (local or in the cloud).

It is a further object of the invention to provide a database of diverse substances, the properties of which, such as preferred viscosity, preferred temperature or preferred illumination exposure are stored and can be utilized to create batch instructions for mixing, blending and illuminating a specified amount of substance detected in the container or specified by the user.

Connector kits (local or in the cloud) further authenticate client applications connecting directly thereto by using the RSA keys that the client application previously gathered from the cloud API and allowing client applications to read historical data, control available sensors and relays, sign-off batch instruction sets and view live, archival and real-time information.

Integral to the control, monitoring and reporting of temperature by the connector kit (local or in the cloud) are sensors for monitoring and reporting the temperature to the connector kit (local or in the cloud) and relays which have the capability to control temperature in accordance with sets of batch instructions or prescribed programs.

In summary the primary components can be described as comprising at least the following:

cloud subcomponents comprising the API for data storage, authentication, etc.;

a websocket for real-time communications;

client applications for viewing data, controlling and sign-off or validation; a connector kit (local or in the cloud) for collecting sensor data, operating controlling relays and synchronizing data with the cloud;

sensors for monitoring and reporting temperatures to the connector kit (local or in the cloud); and relays for controlling temperature in accordance with set programs;

an interface with the container such that duplicate communication and control can control the container by both the client application via or through LED touch screen provisioned with separate microprocessor control to independently provide commands to said relays and sensors deployed in said container as well as receive feedback from or provide feedback to the overall client application as well as being displayed on the container's screen.

A microprocessor will enable functions of the GITD cosmetic container processing commands wirelessly or manually. An LED screen is mounted on the container in communication with the microprocessor in order to show menus on the display which duplicate the screens shown on other means of control such as mobile devices, desktop or laptop computers, tablets, smartphones and smart watches.

Commands by users via client applications will control the power to start and stop the unit, functions such as: processing instruction sets for batches of lotions, oils, cosmetics and GITD lubricants and which specify mixing speeds and durations, temperature ramping and monitoring sensors communicating status of each variable. The database of instruction sets will be preset to safe ranges for variables like temperature. Timer sensor control is activated for safety confirmation to prevent a lotion, oil or cosmetic from getting too hot for use or too hot for the preferred consistency of the substance being warmed.

With respect to the container itself, a drive shaft can be activated for mixing and blending. The driveshaft coupled to a rotating set of mixing blades or paddles is the first mixing and blending option. The driveshaft can be preset to a low or high speed, ramped up or down according to the mixture specifications in the database, be variable for set times or in response to other criteria such as viscosity resistance, measured in the amount of energy needed to continue mixing at the specified speed. As the viscosity changes, the amount of energy needed to spin the blades or paddles will decrease signaling that the desired viscosity has been reached as stored in the database.

Another option for blending and mixing uses a magnetic coupling instead of a driveshaft. The magnetic coupling is well suited for timed mixing and is similarly sensitive compared with the driveshaft option. Where the driveshaft can deliver good starting torque from its motor for substances of heavier viscosity which demand more force to begin the stirring and blending process, the magnetic coupling can be well suited for later mixing runs such as after a lotion, oil or cosmetic has been blended fairly recently and yet needs a bit more mixing to maintain consistency.

It is a further object of the invention to achieve a container with longevity such that rigorous mixing, heating and illumination can be achieved without prematurely wearing out the device. One way to assist in this objective is to employ both a driveshaft and magnetic coupling be employed individually or in combination to mix the substance. The driveshaft may be releasably coupled to its motor so as not to increase the force necessary for the magnetic coupling to operate. The releasable coupling means can include but is not limited to gears, teeth or splines of predetermined length which engage with the motor at a set position but which may be disengaged by vertical repositioning of the shaft in conjunction with activating the magnetic coupling. The vertical repositioning can be by mechanical, electrical or magnetic means. Alternating between these mixing methods also extends the life of the motor and the magnetic device can provide optimum control of the mixing and blending function of the container.

As stated, the instruction sets in the database will contain reference values for time duration, mixture volume dictated by substance, desired temperature and desired illumination.

Existing temperature can be monitored by a variety of temperature sensors placed in the container such as a thermocouple in the base or near a side of the container. A volume sensor which, for example could read the level of mixture by sensing differences in transparency vertically along the container wall or alternately temperature differentials along container walls could be utilized. In another embodiment, a camera could be provided near the base or top of the container extending outward sufficient to get an angled view of the see-through container confirming how far up or down the container wall opaque liquid levels reach remotely indicating how full the container is at that moment. Volume level can also be manually input by the user through the client application. Based on the type of mixture; i.e, lotion, oil or cosmetic, the instruction set would set time durations for heating, mixing and illumination then annunciating the status to the user through the client application as measures by the container sensors or manually input by the user through the client application.

Important for the proper use of the container, the volume of substance in the container prior to executing an instruction set must be sufficient to prevent overheating of a small amount of substance. The aforementioned volume sensor may be continually monitored by the onboard microprocessor and in the event substance volume is lower than a preset level according to product parameters, the user will be prompted by a message displayed on the LED screen suggesting that the user replenish substance in the container. In situations where the substance volume is below a preset minimum level, the unit will not provide the heat function or may be set up to be temporarily inoperable or require a physical reset by the user prior to proceeding.

As an example of the instruction set for a pigment based GITD lubricant, based on the volume of lubricant, mixing and blending rare earth minerals settle at the bottom of the container, having substantial weight and therefor, may first need shaft driven mixing. After the minerals are heated to a desired temperature and the mixing is complete, the mixing ceases at least temporarily. To avoid the minerals from settling out, intermittent mixing may be applied by either shaft driven or magnetic means, while maintaining the temperature specified in the database instruction set. As part of the instruction set, a light emitting diode positioned at a predetermined position on or in the container is energized to provide illumination to the lubricant. The duration of the illumination is also specified in the instruction set. The amount of illumination is variable from a low level of light emission up to a maximum or highest level of emission and all levels in between. The user may set this level in the client application on a mobile device (similar to the brightness setting on a smart phone) or the LED touch screen on the container.

It is a further objective of Applicant's invention that each instruction set executed by the system whether manually or remotely is archived in the database recording each parameter such as duration of heating, heat level, mixing, illuminating and product type.

It is a further object of the present invention to allow data storage which is suitable for sharing on social media.

Along with the above described archival activity, the client application permits the user to enter information or notes on the success of: the end product result, or other social media adaptive content including but not limited to uploading photos, videos, audio or other recordings of user's use or application of the product into a specific section of database storage. The client application is further configured to provide capability of sharing user data on social media sites, messaging platforms and other internet websites providing internet access to same and allowing the user to share the uploaded data, form user groups, determine locations of nearby users in the case of mobile device client app function, and otherwise maximize the capability to share information with like-minded users, social media platforms and fully interface and communicate with other internet websites.

It is a further objective of the present invention to provide a means for users of the smart containers to share their experiences using their smart container on social media sites, able to export different batch run instruction sets, share photos and videos, establish, join and participate in user groups, be able to locate other users online, purchase products for use in the containers provided by sponsors acquired by Applicant and generally establish a creative online society of users of the smart container.

The client application further allows the user to select instruction sets from the database which apply to each lotion, oil, cosmetic or GITD lubricant to be downloaded or synced to the container microprocessor and an onboard memory provide on or installed within the container itself, most likely in the base. The selection may be started by product category and then sub category choosing several instruction sets which cover all parameters needed for preparation of the substance according to the volume and beginning temperature, viscosity or illumination parameters. In most cases, viscosity can be linked to temperature making the viscosity resistance measurement function unnecessary for that particular substance. In this way, with the container not being connected to wifi or other means to the cloud, the user may still select a product via the container-mounted LED screen and begin a batch process via the appropriate instruction set.

The container is capable of communicating with the cloud via the provision of the necessary wifi connection components described above, or in another embodiment, may have an interface with a docking station which is compatible with and in communication with the container wifi or other protocol adapter, the onboard microprocessor and power interface for recharging a battery on the container. The docking station may also perform wireless charging via electromagnetic fields to transfer energy between the container and the charging station through inductive coupling, the configuration of each allowing the necessary proximity of battery and charger required for accomplishing such charging. Further, a USB port can be provided on either the container or a docking station for recharging an external device and/or accessing stored data on said device.

With respect to the LED screen, it has, through established menus, ability to control all operation of the container manually. These functions include: power on, power off; status of all sensors, all sensor readings, and individual sensor readings; substance selection such as lotions, oils, cosmetics; and database reviews of archived batch processes. Furthermore, selections as to product substance, and container volume may be made thereby defining instruction sets downloaded from the cloud database. Operability of individual parameters such as heating, mixing and illumination activation are further provided. System local control such as recharging, wireless modes and system integrity are available. Selection of preselected product instruction sets are also accessible. Battery level and system notification selections round out the basic LED screen functions.

BRIEF DESCRIPTION OF THE DRAWINGS

FIG. 1A is a cross-sectional elevation view of a first embodiment of the invention, in which FIG. 1B shows the components thereof separated for a method of use.

FIG. 2A is a cross-sectional elevation view of a first embodiment of the invention, in which FIG. 2B shows the components thereof separated for a method of use.

FIG. 3A is a cross-sectional elevation view of a third embodiment of the invention, in which FIG. 3B shows the components thereof separated for a method of use.

FIG. 4A is a cross-sectional elevation view of a fourth embodiment of the invention, in which FIG. 4B shows the components thereof separated for a method of use.

FIG. 5A is a cross-sectional elevation view of a fifth embodiment of the invention, in which FIG. 5B shows the components thereof separated for a method of use.

DETAILED DESCRIPTION OF THE INVENTION

Figures 1A, 1B:
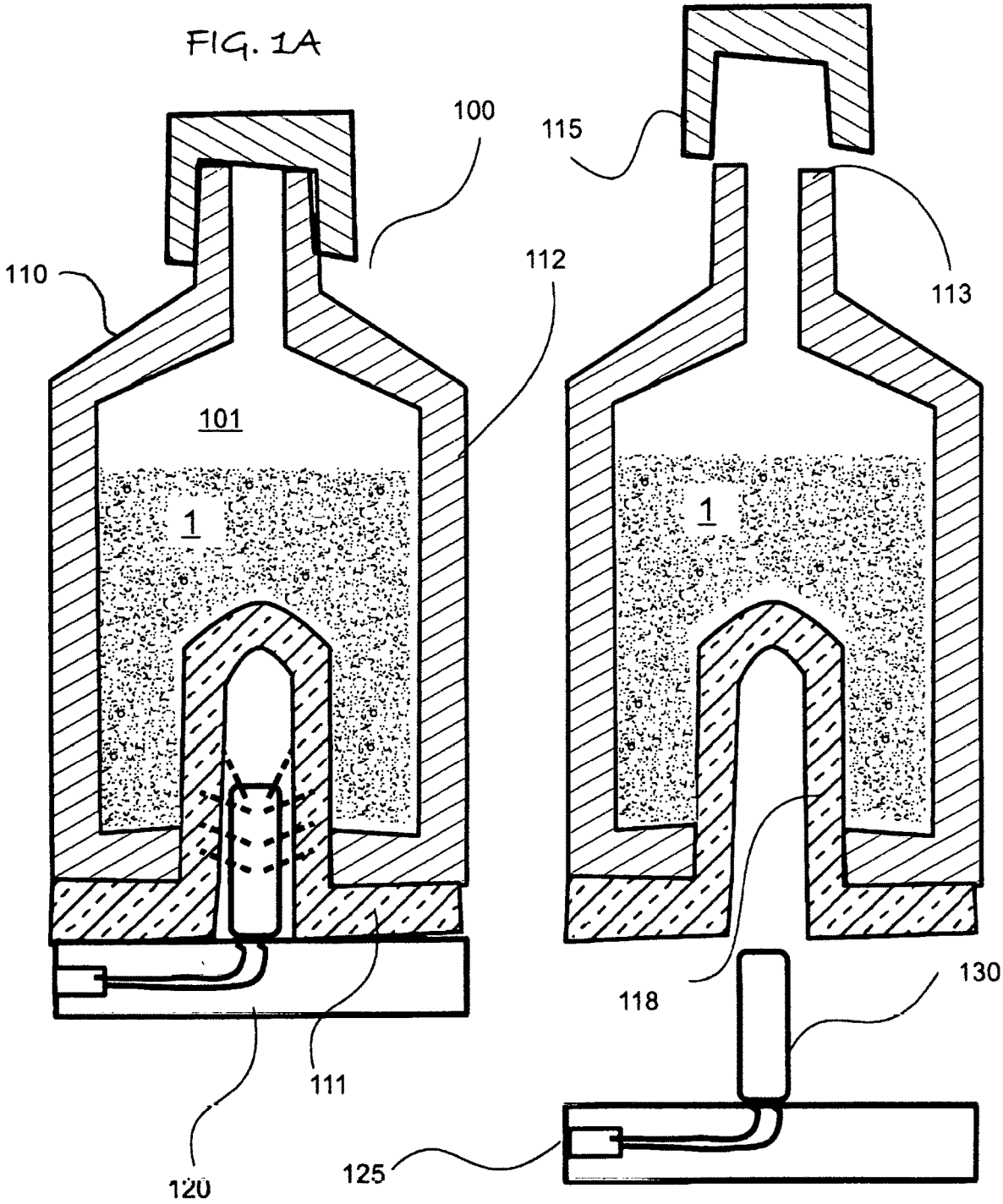

Referring to FIGS. 1A through 9, wherein like reference numerals refer to like components in the various views, there is illustrated therein a new and improved Container with Illumination Source, generally denominated 100 herein.

In one aspect, the aforementioned limitation to luminescent products for topical application is overcome by storage in a dispensing container having an integrated light source and means to energize the light source.

Such a container 100 as depicted in FIG. 1A-1B is a fluid dispenser which generally comprises a container 110 having a bottom portion 111 connected to side walls 112 that surround the bottom portion and then extend substantially upward to terminate at an upper rim 113. A cap or closure device 115 is removably connected to an upper portion of the container to form a fluid resistant seal at the rim 113. The portions of the container 110 between the bottom portion 111 and sidewalls 112 defines a cavity 101 for confining a fluid I that is to be dispensed either at the rim 113, such as when the cap 115 is removed, or opened at sealable opening within the cap 115, such as a pouring spout or spray nozzle, and the like.

In the various other embodiments there are several alternative and not mutually exclusive means to connect an illuminating base 120 to the bottom 111 of the container 110 so as to dispose a light source 130 in optical communication with the fluid 1 contents having a luminescent property that are stored in the cavity. It is the object of the invention to enable the illumination of the fluid contents such that they are luminescent when being dispensed via the cap 115.

In the embodiment of FIG. 1A-5B, a transparent inner annulus 118 that extends upward from the bottom portion 111 of the container at least partly upward into said cavity 101, such as in the form of a punt in a wine bottle. In such embodiments the light source 130 is preferably disposed within the inner annulus 118 to irradiate the fluid I that is contained within the cavity 101.

The fluid 1 is one of body paint, massage oil, external lubricants, internal lubricants, lotions, creams or moisturizers, face paint, make up and the like. By fluid, we also mean a gel or cream that is relatively viscous, such as Vaseline™, as one example of a brand of petroleum jelly. Such formulations can be conventional but include at least one component having a luminescent property, such as a soluble chemical compound or dispersed phosphorescent, fluorescent or luminescent pigment, such as those disclosed in the aforementioned US patent application number 2008/US20080057089 A1.

A light source 130 is optionally disposed in optical communication with the interior contents of the container 100 through one or more transparent portions, such as the annulus 118, or portion of the sidewall or an upward intruding internal light pipe, or any other internal lighting element. The light source 130 is preferably a light emitting diode (LED) that emits blue light, which is light with wavelengths generally less than about 450 nm. The light source 130 is also preferably energized by an external source which is connected at an external socket connection 125, which is wired to the light source 113, but can also be energized with a battery that is either replaced or re-charged through the socket 125 via a charging circuit, or by a main power source (120 VAC in the US).

FIG. 1A illustrates a first embodiment of such an invention in which the light source 130 and the external socket 125 are contained in a removable base element 120. FIG. 1B illustrates the container 100 separated from the removable base 120 with the cap 115 removed from the rim 130 of the container so the fluid content I can be removed and used to dispense the contents remote from the base 120.

The connection to the external socket 125 is preferably of a standard format used for charging mobile phones, smart phones, tablet style computing devices and personal computers and the like. Such as, USB format, micro USB, as well as proprietary formats found on Apple™ brand computer products and Android OS™-based computing products and displays.

In a more preferred embodiment of the invention, the container 100 has one or more transparent inner core member, such as the transparent annulus 118 for receiving a detachable light source 130. The detachable light sources 130 is on a base 120 that includes either a power supply, or an external plug connection to an external power supply. The inner core of the container is transparent to the light emitted by the light source. The detachable light source 130 is optionally firmly attached to the container, such as by a screw, bayonet or snap fitting, so that a user can externally agitate the container contents so that the fluid therein mixes and is uniformly exposed to the light source before the fluid is removed from the container via an upper opening at the rim. The attachment can be via the base 120, or the light source 130 can be part of the container 100, in which case the base 120 also provide an upward facing socket type electrical connection to the battery or charging/power socket of the base.

In various more preferred embodiments, container 100 also has an integrated heater element 140 in thermal communication with the contents of the container. Such heating elements 140 are optionally etched foil resistive heating elements, which can be embed in the container walls or base, but are conventionally embedded in silicone rubber to be placed adjacent to the container 100. Heating elements are also optionally positive temperature coefficient resistive heating elements, thin film heating elements and the like.

FIGS. 2A and 2B similarly illustrate a second embodiment of the invention in which the removable base 120 further comprises an annular heating element 140 disposed around the light source 110 but in thermal communication with the bottom portion 111. The position of the heater element 140 and light source 130 can also be reversed, with the heater in the inner annulus 118 and the light source 130 surrounding it to illuminate a transparent base 111. A plurality of separate light sources can be arranged around the perimeter of the base 120, or around external side walls 112 that are transparent.

FIGS. 3A and 3B similarly illustrate a third embodiment of the invention in which the removable base 120 has heating elements 141 that form an annular wall that surround the lower portion of the container walls 112.

FIGS. 4A and 4B similarly illustrate a fourth embodiment of the invention in which the removable base 120 has a battery 150 disposed therein for powering the light source 130, in which the battery 150 is preferably but not exclusively charged by an external socket connection 125.

It should be appreciated that it is desirable for the container cavity portion 101 between the outer walls and the inner annulus be sufficiently thin with respect to the output of the light source and the extinction coefficient of the fluid with respect to the exciting wavelengths of light for luminescence that sufficient light reaches most of the fluid within the container. However, it is also anticipated that in use a user will lift and shake the container so as to more fully distribute the fluid therein, allowing any portion of the fluid that has not been illuminated to mix and become exposed to light source 130 with additional time.

It may also be desirable that some portion of the container 100 have an exterior transparent window 116 so that a user can extinguish the room lights to determine if the contents are sufficiently charged with light to exhibit phosphorescent or fluorescent properties when the light sources de-energized.

Such an embodiment is illustrated in FIGS. 5A and 5B in which an upper portion of the container is transparent, forming window 116. The embodiment of FIG. 5B also illustrate a mixing blade 501 assembly disposed about the annular portion 118. The mixing portion or mixing blade assembly can be a fixed a series of static mixing blades that are rotated and curves, or blades that rotate when the bottle is agitated, or a blade assembly rotated by an axial connection 502 with the cap, such as via a magnetic coupling so the cap can be removed. Alternatively, the cap 115 can have a secondary dispensing orifice and rotate on the rim 113 to rotate the axial member and stirrer assembly 501/502. Alternatively, the stirring blades can be any shape or types, and are also optionally coupled to base 120, such as with a direct or geared drive shape penetrating the bottom of the container, or with a magnetic stirring assembly. In either case, the base may deploy a motor to rotate the base magnet, which attract the internal stirring bar or assembly the co-rotates to mix the content or drives blades.

A more preferred embodiment is a transparent container, which can be entirely or partially transparent, in which the stirring assembly rotates and translates axially with the bottom. They can be accomplished with a stirring assembly that encounters an internal circular ramp in the interior bottom. An axially bottom penetrating drive shaft can also drive a cyclic vertical translation with simultaneous rotation, provide the stirring assembly can freely translates on it, such as with an internally sealed telescope in the axle. It is anticipated that such an embodiment would also provide a dynamic and decorative glow effect as the luminescent material mixes and translates, the disappearance of mixing striations indicating the luminescent material is fully charged with photonic energy for dispensing at the highest brightness. Any embodiment of the mixing blades may deploy sets or shape or serrated protuberance, such as teeth, that aid in breaking up and dispersing hardened agglomerate of pigment material, which can also be softened by warming with heaters or heat emitting light source.

Figure 9:
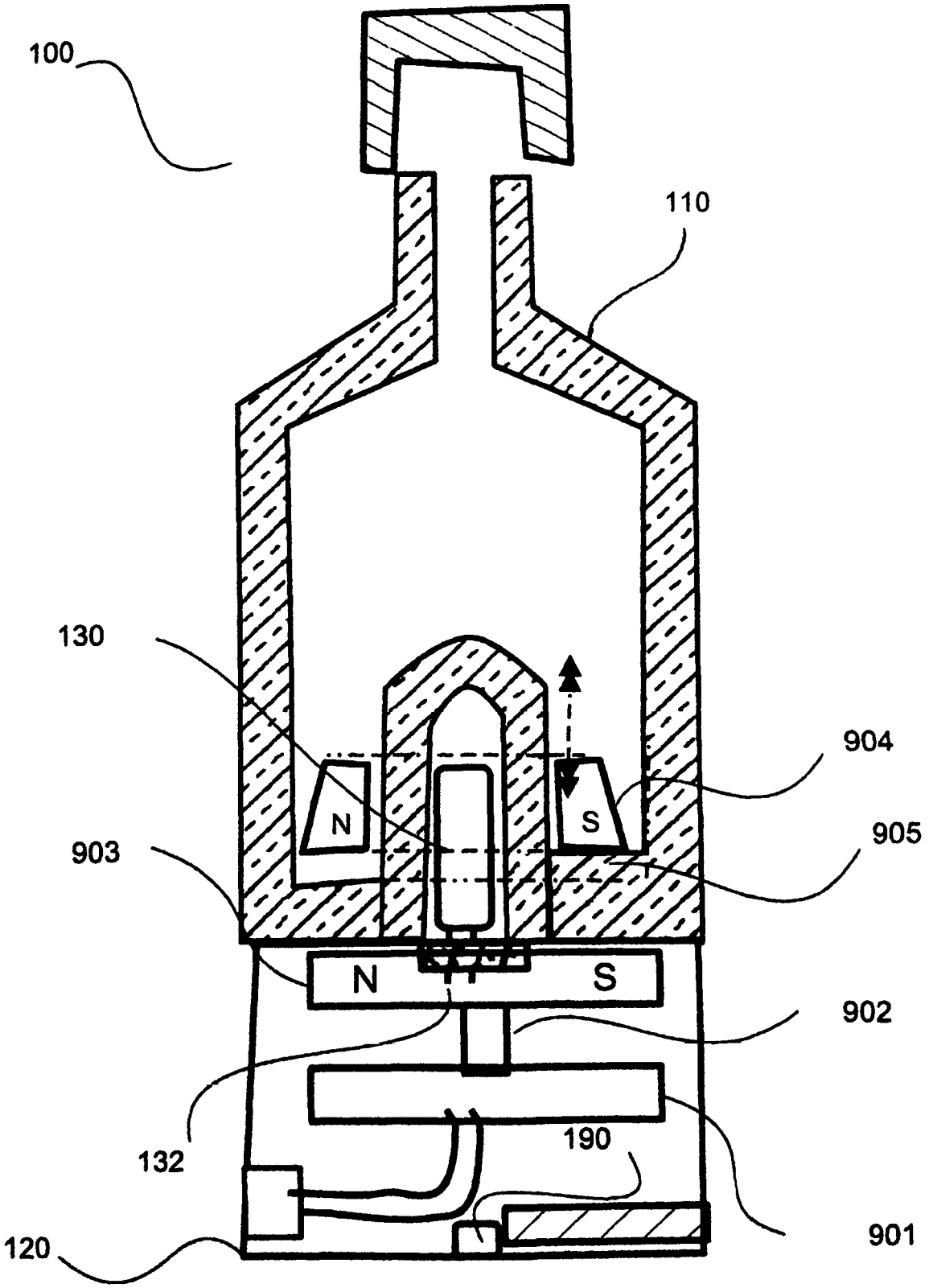
FIG. 9 is a cross-sectional elevation view of another embodiment of the invention.

In such embodiments, the annulus can be combined with mixing blades, fins, bar and the like, which extend radially. When such an embodiment is combined with a magnetic drive for the mixing, the light from the light source can illuminate the annulus via a window in the base to avoid penetrating the bottom of the container, which is transparent adjacent container bottom. Alternatively, the blades can use the annulus containing the bulb or light source 130 as a central rotating hub. This embodiment is illustrated in FIG. 9 showing a motor 901 in the base 120, which drives shaft 902 that is connected to a magnetic annular disk or magnet array on a disk 903, in which the light source electrical connection is through the central bore of the annular disk 903. The motor 901 thus rotates the magnet 903 in the base, which rotates the stirrer blade assembly 904 with embedded magnets, shown as N and S for the pole that aligned with the disk magnet 903. The controller 190 optionally controls the motor 901 to conserve battery power when not connected, if desired by the user per the remote programming of portable electronic devices, such as smart phones, and tablet computers. Wiring to the light source 130 can be through an axial bore in the motor, or the motor 901 can be offset from the light connection to drives the shaft 902 or magnet 903 by a gear assembly. It should be appreciated that any battery can be charged by inductive coupling chargers that do not require a wire connection. It should be noted that FIG. 9 also illustrates the axial ramp 905 in section view, the right side of the bottle having a thicker bottom, than the left, so the stirring assembly, having a non-planar bottom, rises as the rotation of the stirrer 904 bottom moves up and down with the ramp 905 shape.

Figure 6:
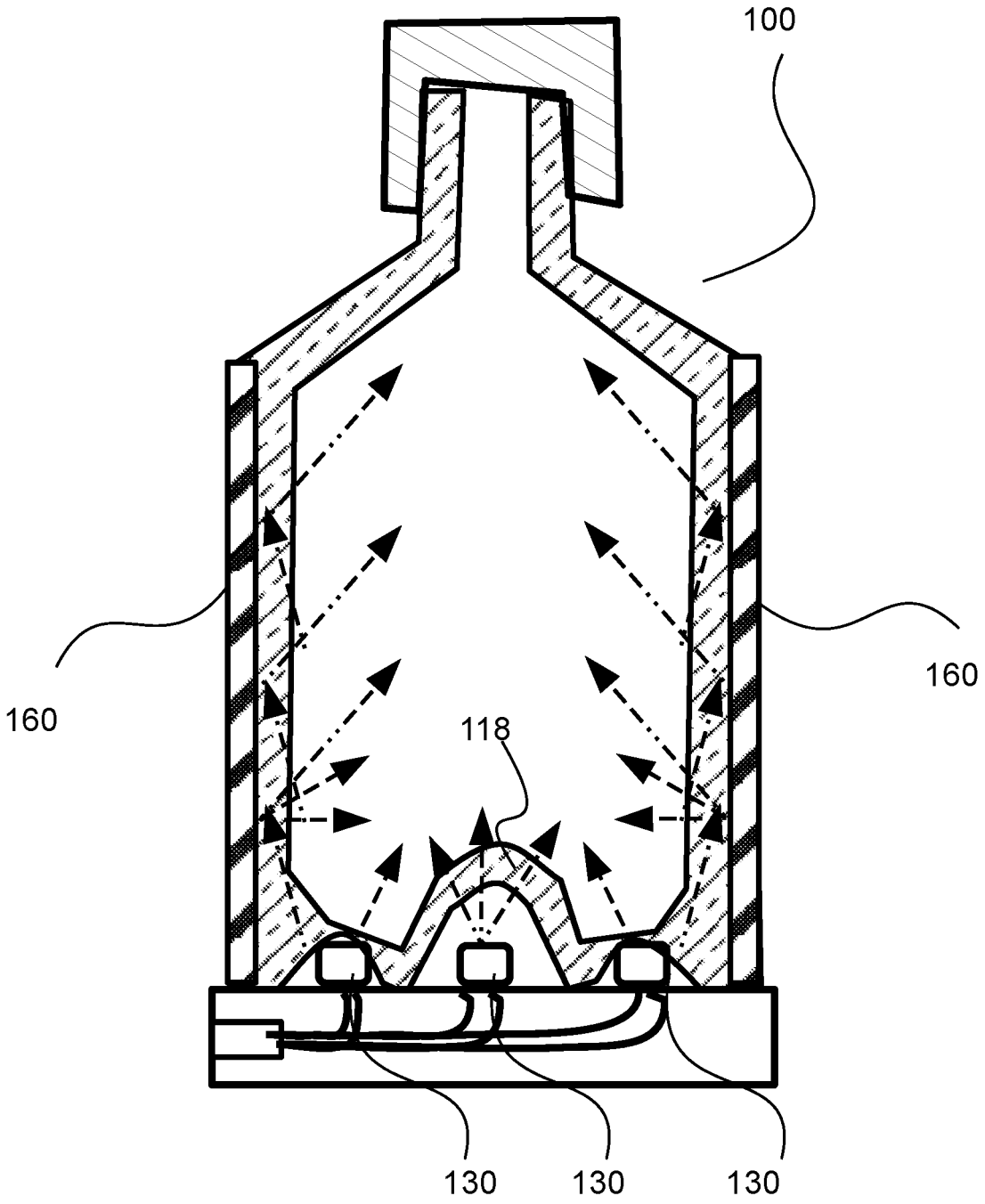
FIG. 6 is a cross-sectional elevation view of another embodiment of the invention.

FIG. 6 illustrates another embodiment of the invention in which the container 110 is transparent and has a metal reflective coating, plating or cladding 160 facing the exterior 112*a* of the side wall. A plurality of light sources 131 and 132 are disposed around the perimeter of the base 120 to inject light into the transparent side walls 112, as shown by broken line arrows. This light is reflected off the metallic coating and into the interior cavity 101 of the container 110. The base 120 may also include a centrally disposed light source 130, which optionally illuminates or extends into the transparent inner annulus. The container walls 112 can have facets for reflecting the light into the cavity 101 and/or the angular distribution of light into the walls 112 can be shaped by lenses associated with the light sources 130.

Figure 7:
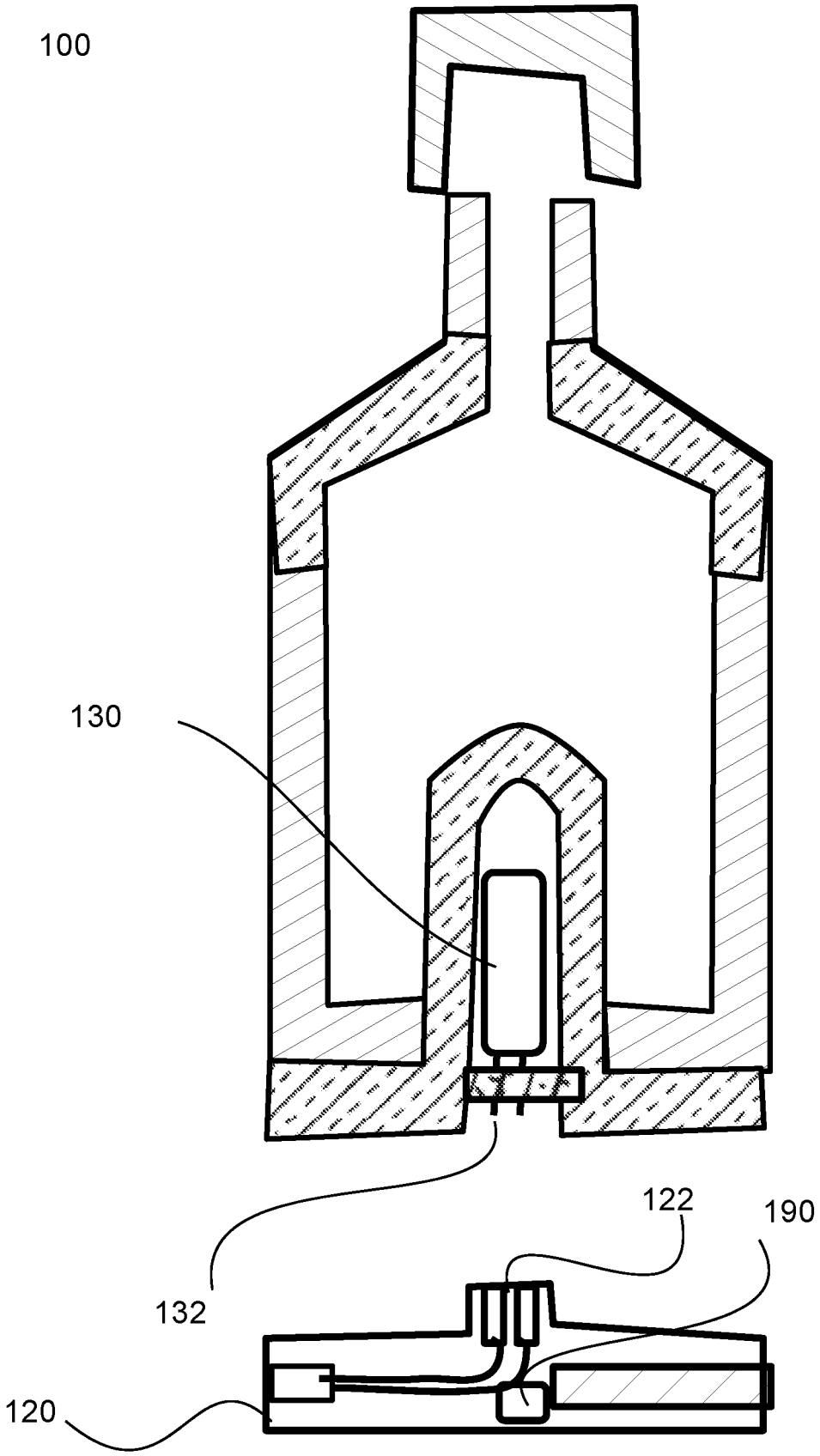
FIG. 7 is a cross-sectional elevation view of another embodiment of the invention.

In the embodiment of FIG. 7, the base 120 includes a controller 190 in signal communication with an external source, such as via a Wi-Fi or Bluetooth™ connection (via a transceiver or transmitter associated with the controller) to energize at least one of the light source and heating/warming elements. Further, such a controller 190 or the external source can signal when the contents are warm, and are fully charged by irradiation to provide the desired illuminant properties when the fluid 1 is ready to dispense, as well as when the contents should be mixed or stirred. The external device is optionally a portable computing device, such as a phone, smart phone or tablet computer and the like. In FIG. 7, the light source is also optionally disposed and fixed in the annular cavity 118, and connects to the base 120 via a mating plug and socket 132 and 122 respectively. The controller 190 may also be in signal communication to activate an external display that is visible at the edge, side or top of the base, such as to display charger status, battery charge state, wireless connection status, temperature, remaining time to charge, remaining time to use, mix, when to shake or otherwise distribute the contents, and the like. Such information can also be transmitted to another device by the controller 190. Further, the transmitter of the controller is also optionally can tuned on/off manually, or can be controlled by the controller via Wi-Fi, Bluetooth™, or cellular phone connection, computer. Further, via a controller the motor and any other hardware or electronic components can be wirelessly activated or energized, or de-activated or de-energized.

Figure 8:
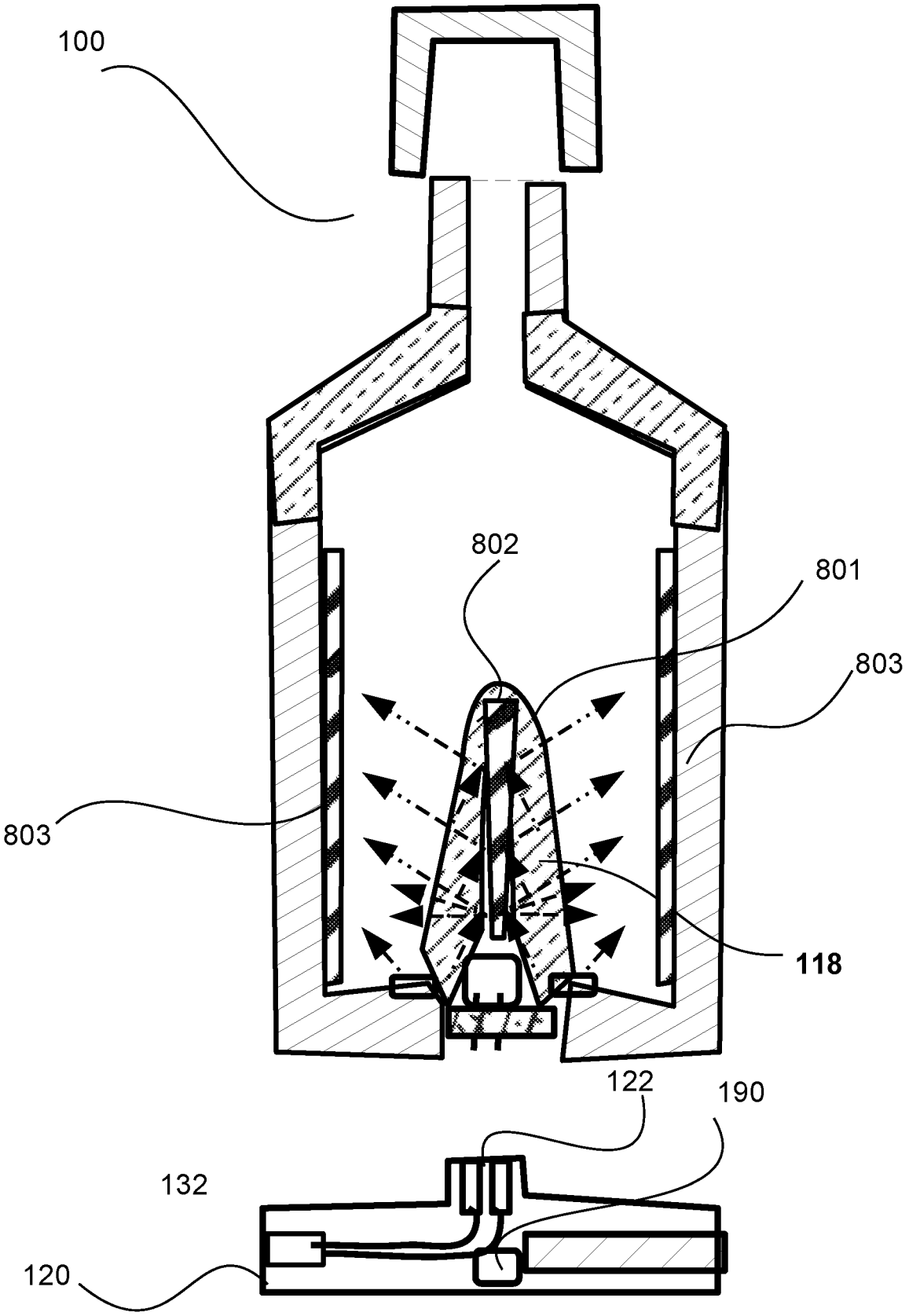
FIG. 8 is a cross-sectional elevation view of another embodiment of the invention.

The embodiment of FIG. 8 deploys a solid annulus or cone 801 that has a reflective metal core 802 such that it acts as a light pipe for the light source in the base. As shown by broken line arrows, light is reflected off the metallic coating or core and into the interior cavity 101 of the container 110. The lower container walls are optionally reflective, having an inner reflective layer 803 or transparent as in FIG. 5 with an outer reflective metallic covering 160. The metal core 802 may have facets to control the dispersion of light broadly into the cavity 101.

An internal or external reflective covering of the container 101 can also function as a thin film heating elements, such as an etched foil heater. The base and controller may also deploy a thermistor, thermocouple or other thermal sensor to prevent overheating the contents and signal from such a sensor indicate the contents have already been warmed to a comfortable temperature or at least a sufficient temperature to re-disperse the luminescent pigment, or lower the fluid 1 viscosity sufficiently to disperse such pigment by one of shaking, stirring and agitating, and the like. Further, the base 120 may container a circuit or micro-switch to detect when the container 110 is removed from base 120, and de-energize the light source 130, and de-energize the heater element(s) 140.

In any of the embodiments, the battery is optionally charged by a photovoltaic source. In any of the embodiments, the lights source can be an LED, incandescent light source, fluorescent light, electroluminescent light and the like. it should be appreciate that an incandescent or other light source can be used both to illuminate and charge the luminescent material, as well as heat the contents. In any of the embodiment, the walls can be rigid or flexible to squeeze the fluid out of a nozzle or opening at the rim or within the cap. The drawings are not intended to represent a particular size or scale, or be construed as limiting in any way. The various illustrations shows cross-sections, as it is contemplated that preferred embodiments will have circular symmetry. However, the container 110 and base 120 need not have exclusivity a cylindrical shape or any particular shape. In any of the embodiments, the base may deploy a plurality of different connector types socket to accept different types of proprietary charger plugs to charge the battery power the heater and or energize the light sources. Further, in any of the embodiment may deploy multiple transparent inner annuluses 118, each illuminating the container cavity by an associated light source and/or the light pipe or cone 801 of FIG. 8, as appropriate to the container size and available output of the light source and the fluids optical properties.

In preferred embodiment the hardware components, such as light source(s), and bulb(s), motor, stirring blades, drive axles, magnets, battery(s), electronic components, and the parts that form the base, can be snapped in or out of mating components to open and replace or remove them from the base for servicing and maintenance of the device 100.

Another aspect of the invention is providing a means to replace the fluid 1 when the container 110 is empty or nearly empty. The container can be refilled by mixing a fluid base, such as a silicone fluid and a powered fluorescent pigment from separate container or pre-measured sealed packet. Such packets can be provided of pigments that fluoresce in different colors, and are preferably alkaline earth aluminates, such as without limitation are strontium aluminate, silicate aluminate, or any alkaline earth aluminate. A number of earth metals can be used depending on the particular product and color desired, including strontium, magnesium, calcium, and barium, to make, for example, barium aluminate, calcium aluminate, and magnesium aluminate. The glowing colors span the spectrum from greenish yellow to purple blue. Silicon or titanium may be added, and each alkaline earth metal aluminate may be doped with europium or other rare earth elements. Further, alkaline earth silicates can be employed, as can silicate aluminate and zinc sulfide, though with notably less luminosity and persistence than strontium aluminate. Alkaline earth silicate produces a sky blue color not produced by alkaline earth aluminates. Yet another alternative is earth mineral crystals.

Figure 10A:
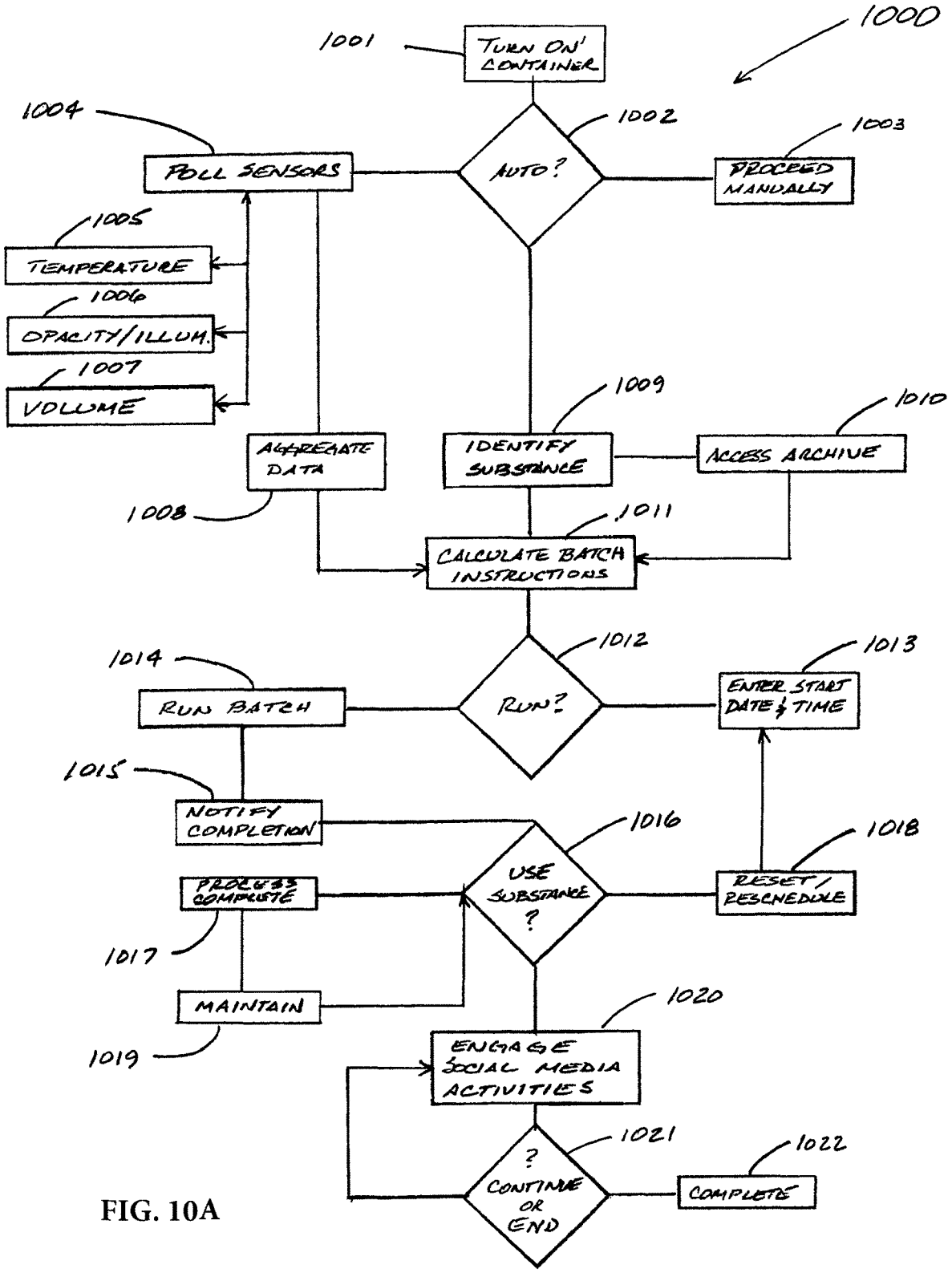
FIG. 10A is a process flow chart illustrating a typical "Choose and Run Preparation application command process on a standard client (smartphone or container-mounted LED touch screen) illustrating options for choosing and beginning the selection of a substance or medium to be prepared in one of the containers shown in FIGS. 1 through 9.
Figure 10B:
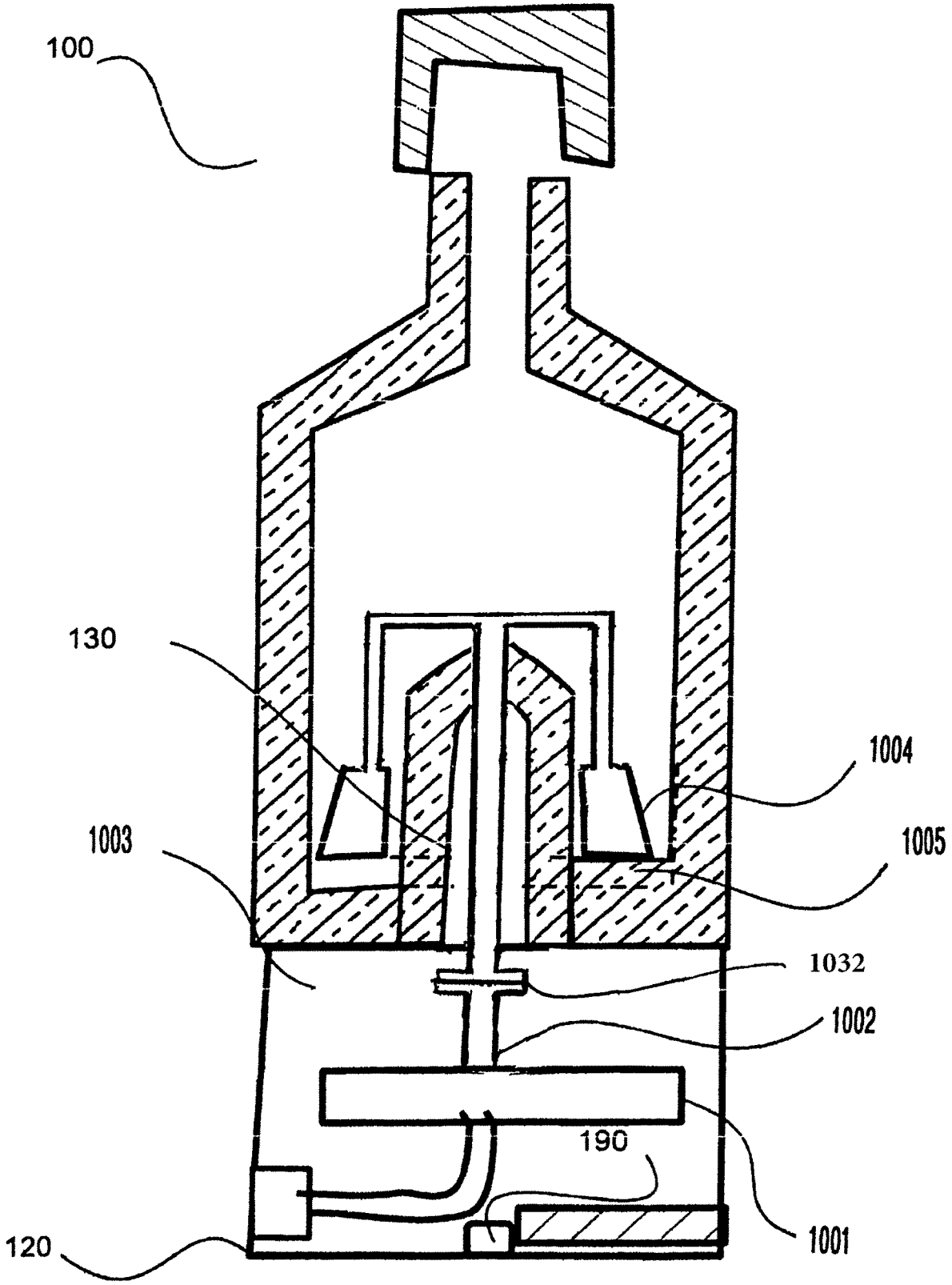
FIG. 10B is a cross section of one embodiment of the present invention wherein a motor drives a shaft with a coupling for turning a mixing blade.
Figure 11:
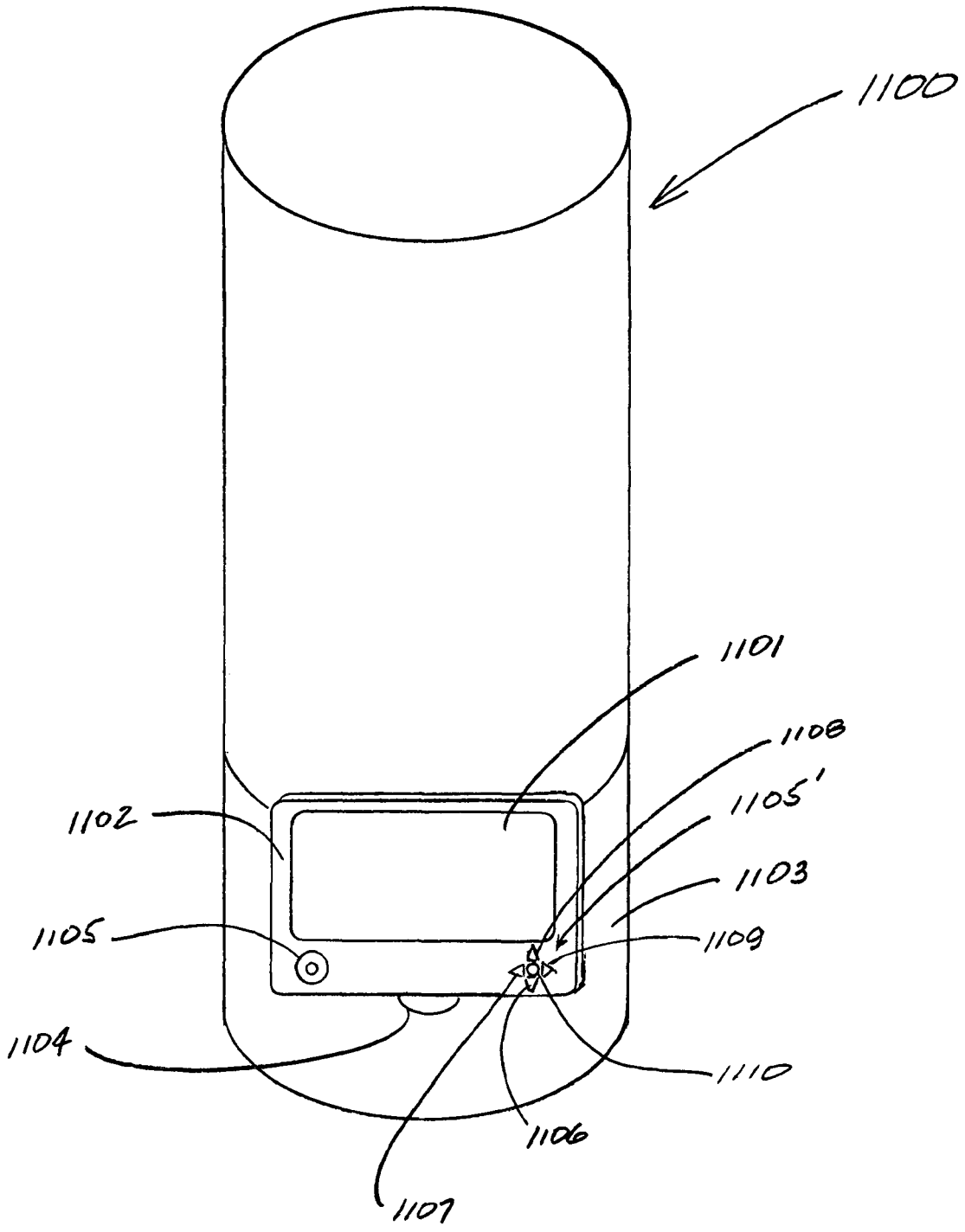
FIG. 11 is a depiction of the container having the LED touchscreen mounted on the base of the container.

As shown in FIG. 10A, the process flow begins after the LED screen is powered on by depressing one of the selection means depicted in FIG. 11 and contains a series of steps to be selected as part of the client application. Throughout the process description, references to displays on an LED touchscreen and selections refer to FIG. 11. After powering on, the user is provided a choice to automatically begin a batch run instruction set starting the application. The selection query "Auto?" depicted as step 1002 provides the user to select a yes option or a no option (not shown) selected by the aforementioned selection means. A selection of no directs the user to step 1003 wherefrom the user can then select a menu of selections to manually select values and instructions which alternately can be automatically calculated and run by the client app by choosing the "yes" selection which then initiates a sequence beginning with step 1004 "Poll Sensors", on through the automatic functions. The manual selection of step 1003 is useful, for example in the case where the user already knows the substance in the container, that it is full and at room temperature, and further if the user also, by experience or by accessing information from the archive understands that high intensity lamination and mixing of one minute will achieve the desired substance result immediately ready to use.

As stated, a "yes" selection of "Auto" selection step 1002 yields the display of step 1004 "Poll Sensors" which then accesses the information available from applicable sensors communicating with "Temperature Sensors" as shown in step 1005, "Opacity/Illumination Sensors" as shown in step 1006 and "Volume Sensors" as shown in step 1007. It should be noted that sensor polling is not a sequential step per se, but rather is an instantaneous reading of these parameters which are then be aggregated as shown in step 1008 "Aggregate Data".

At the same time that the sensor polling has aggregated the status of the aforementioned parameters of the substance in the container, the user is prompted by step 1009 "Identify Substance" prompting the user to select from a menu displaying all the various lotions, oils, GITD substances, cosmetics, scrubs and masks possible. A selection sub-step 1010 "Access Archive" displays a record of the last instruction set run by the client app automatically or manually thereby identifying the substance remaining in the container thereby allowing the user to confirm the substance and then executing the next step 1011 "Calculate Batch Instructions".

At this juncture in the client app, step 1012 option "Run" is displayed providing the option to select step 1013, "Enter Start Date & Time" by selecting a no option allowing the user to schedule the batch run for a future time, or by selecting a yes option which then proceeds to step 1014 "Run Batch".

Upon completion of the batch run, step 1015 "Notify Completion" is a notification function which alerts the user that the substance preparation is complete. Sensor polling has continued throughout the batch run until all parameters have been achieved and that the batch run instruction set has been satisfied complete. These parameters are compared with the archived data comprising both experience data from previous runs or standard batch set instructions which select illumination, heating and mixing run times already known to be necessary given the parameters of all selected and loaded substances in the database.

It is further worthy of note that these same steps are capable of being run from a mobile device either as a substitute for the onboard LED touchscreen or in parallel as the user may have stepped away from the container during the batch run and may be continuing the operation of the client app on a mobile device.

Once step 1015 has displayed, a selection step 1016 "Use Substance" is displayed with a selection of step 1017 "Process Complete" which allows the user to either terminate the batch run or step 1018 "Reset/Reschedule" which reverts to step 1013 to schedule the batch run later and pick up the auto sequence at the predetermined time.

By choosing step 1017, an option to choose step 1019 "Maintain" is offered which can be selected to continue to maintain the parameters at the optimum temperature, and illumination while continuing to mix as prescribed by the batch runs in the database for a specified period of time such as 15 minutes, 30 minutes, etc. Selecting step 1019 and selecting a maintenance time or not returns the process to step 1016 with an affirmation of the user's intent to use the product and not reschedule. Step 1016 "Use Substance" then gives the user the opportunity to choose step 1020 "Engage Social Media Activities" which allows the user to use the client app to access the social media platform of choice in which to upload images, videos, audio recordings, etc. A selection is also available to use without engaging social media.

At some point during the activity, by touching the LED touchscreen of FIG. 11, or in a predetermined amount of time, say, for example, 15 minutes, step 1021 is displayed prompting the user to either continue or end the client application. If an "end" selection is chosen, step 1022 "Complete" appears to confirm that the user wishes to terminate the use thereby rendering the container dormant. A "yes" selection continues gives the option to continue use with the engagement of social media. Step 1021 also provides a selection option for the user to continue to use the substance without engaging social media. If so chosen, the touching of the LED touchscreen can again be used to select step 1022 or to continue at the user's discretion.

FIG. 11 depicts a preferred embodiment of Applicant's smart container 1100 (lid not shown) showing an LED touchscreen 1101 housed in a receptacle 1102 and mounted on container base 1103 through a smart connection 1104, said receptacle having there inserted optional scrolling and selecting means, 1105 and 1105'. In another embodiment of Applicant's invention (not shown), the LED touchscreen is integral to the base of the container. Scrolling and selecting means 1105 comprises a trackball which can direct a curser on screen 1101 to a selection whereby the user may then depress trackball 1105 making a selection.

In the case of scrolling and selecting means 1105' a set of four arrows, 1106, 1107, 1108 and 1109, each pointing in incremental 90 degree directions akin to north, south, east and west, are proximate to and equidistant from a button 1110 centered between the arrows allowing the user to scroll through selections displayed on touchscreen 1101 and make a selection by depressing button 1110. By these scrolling and selecting means, the user can control the functions of container 1100 provided by the client application.

Either trackball 1105 or button 1110 may power on the touchscreen by depressing either selection means for a predetermined time period, for example five or ten seconds.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims. More particularly, it while the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims. More particularly, it should be understood that the disclosure of a particular features, aspect or variant with respect to one embodiment is not intended to preclude combinations or exclusions of such features, aspects or variants from others embodiments.

The invention claimed is:

1. A substance dispensing container comprising:

a) a container having a bottom portion, substantially upright sidewall surrounding the bottom portion which terminates at an upper rim, and a cap removably connected to an upper portion of the container, wherein portions of the container between the bottom portion and the sidewall define a cavity for confining a fluid, b) a transparent inner annulus that extends upward from the bottom portion of the container at least partly upward into said cavity, c) a means to connect an illuminating base to the bottom of the container so as to dispose a light source in optical communication within the inner annulus to irradiate the fluid within the cavity, said light source further comprising a light emitting diode (LED), said illuminating base further comprising a heating element that is disposed in thermal communication with the bottom and a lower portion of the sidewalls of the container when the light source is disposed within the inner annulus, said illuminating base further comprising an external socket for receiving a power connection, wherein the external socket is wired to one or more of the light source and the heating element, wherein the fluid includes dispersed or dissolved luminescent material therein at least partially filling the container, and wherein the base comprises a motor to drive a mixing blade assembly in the container.

2. The substance dispensing container of claim 1 wherein the motor drives a magnet in the base which is magnetically coupled to a magnet in the mixing blade assembly.

3. The substance dispensing container of claim 2 wherein said annulus further comprises a temperature sensing device, the sidewall has disposed along a sidewall length a means for determining opacity and substance volume, said illuminating base enclosing a cavity with an opening at a surface of said base, said cavity housing circuitry for a microprocessor, communication means, operational relays, temperature and opacity sensor connections, USB connections, a communications interface at said cavity opening of a base outer surface, said communications interface sufficient to receive an LED touchscreen controller whereby sensors and relays may be operated to sense temperature, opacity and illumination, operate the mixing blade assembly, LED light and heating elements according to a set of instructions received by a client application.

4. The substance dispensing container of claim 3 wherein an LED touchscreen assembly comprising an LED touchscreen housed in a receptacle, said receptacle also containing sufficient microprocessing and communication components, said LED touchscreen assembly further comprising a communications interface for communicating with said circuitry within said illuminating base, said assembly further capable of receiving instructions from a mobile device running a client application in order to fully communicate with and operate said substance dispensing container.

5. The substance dispensing container of claim 4 wherein said LED touchscreen assembly having microprocessing circuitry sufficient to run the client application without communicating with a mobile device.

6. The substance dispensing container of claim 5 wherein said LED touchscreen assembly further comprising a camera capable of recording video during use as well as monitoring the volume and the opacity of the substance in the container.

7. The substance dispensing container of claim 1 wherein the motor drives an axle that penetrates the container bottom which has a mechanical coupling to the mixing blade assembly.

* * * * *